United States Patent [19]

Roncaglione

[11] 4,195,491

[45] Apr. 1, 1980

[54] DRY ICE REFRIGERATOR

[76] Inventor: Walter Roncaglione, 2881 NE. 35 Ct., Fort Lauderdale, Fla. 33308

[21] Appl. No.: 946,496

[22] Filed: Oct. 18, 1978

[51] Int. Cl.[2] ..... F25D 3/12

[52] U.S. Cl. ..... 62/384; 62/125; 62/457; 73/40; 137/67; 251/122

[58] Field of Search ..... 62/125, 384, 388, 457, 62/459, 464; 73/40; 251/122; 137/67

[56] References Cited

U.S. PATENT DOCUMENTS

| | | | |
|---|---|---|---|
| 1,959,863 | 5/1934 | Griss | 73/40 |
| 2,610,472 | 9/1952 | Maxwell | 62/384 |
| 3,820,355 | 6/1974 | Olivares | 62/384 |
| 3,855,816 | 12/1974 | Miller | 62/457 |
| 3,959,982 | 6/1976 | Denis et al. | 62/457 |

*Primary Examiner*—Ronald C. Capossela
*Attorney, Agent, or Firm*—Krass & Young

[57] ABSTRACT

Apparatus for converting a conventional insulating picnic cooler or the like into a refrigerator includes a small container, disposable within the cooler, for dry ice. A rectangular frame insertable within the interior of the cooler includes a pair of refrigeration coils which are disposed in proximity to opposed side walls of the cooler. One end of each of the coils connects to the dry ice container. The other end of the coils connects to a manually adjustable valve having a pressed blow-out section for relieving excess pressure. The valve is disposed in the exterior of the container. Gas flowing through the valve from the coil passes to the atmosphere through an indicator having a body of fluid in a transparent window so that bubbles produced upon passage of the gas are visible and allow manual adjustment of the valve to control the rate of gas flow and thus the rate of sublimation of the dry ice and the temperature within the cooler.

14 Claims, 8 Drawing Figures

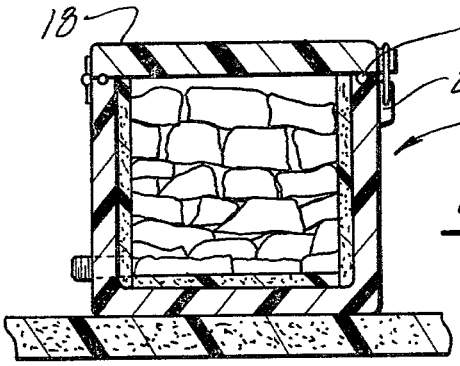
Fig-5
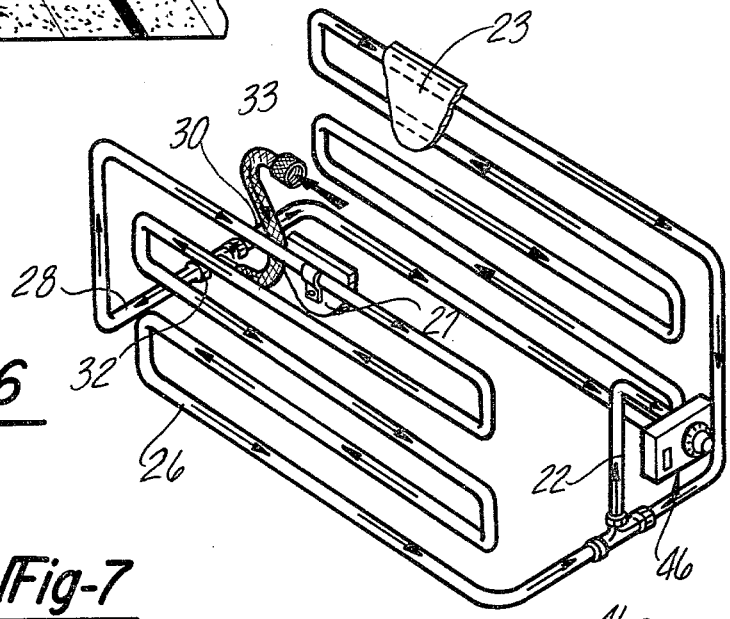
Fig-6
Fig-7
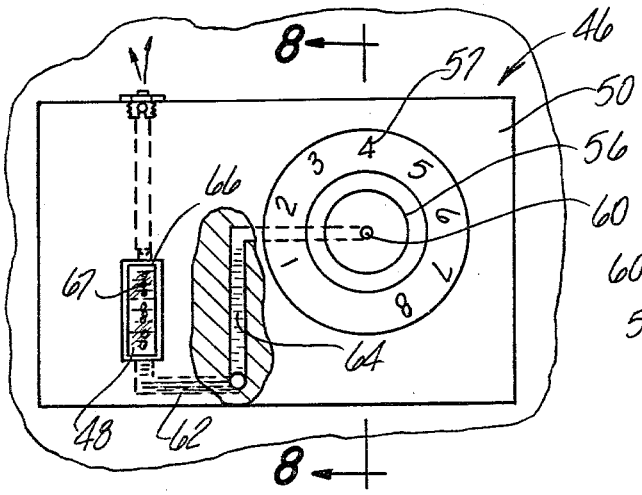
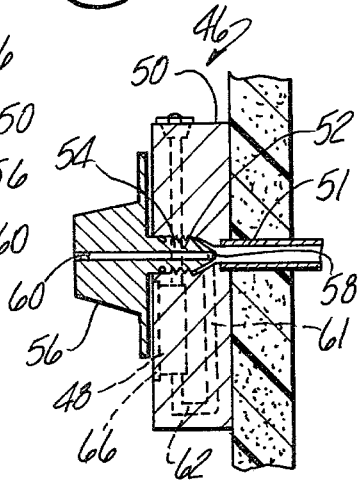
Fig-8

DRY ICE REFRIGERATOR

BACKGROUND OF THE INVENTION

1. Field of the Invention

This invention relates to coolers employing the gas produced upon sublimation of refrigerated solids such as dry ice and more particularly to a simple refrigerator structure well adapted for use with portable coolers.

2. Prior Art

Refrigeration systems employing the cooling effect produced upon sublimation of refrigerated solids such as "dry ice" or frozen carbon dioxide, where widely employed prior to the introduction of economical mechanical refrigeration systems. Dry ice is produced by the refrigeration of carbon dioxide to very low temperatures under conditions of high pressure, and at higher temperatures and atmospheric pressure the solid sublimates endothermically to produce a low temperature gas.

Dry ice refrigeration systems are inherently portable and are still used for ice cream trucks and the like. Generally, these systems simply employ a quantity of dry ice within an insulated compartment and allow the dry ice to sublimate at a natural rate to cool the compartment. No provision is made for controlling the temperature of the compartment other than modifying the quantity of dry ice employed.

Portable insulated boxes for maintaining foods and beverages at refrigerated temperatures through use of conventional ice are very commonly employed and are often termed "picnic coolers". Refrigerated temperatures may only be maintained in these units for short periods of time because of the quick melting of the ice and the water produced upon melting limits the manner in which the units may be packed with foods. For these reasons they are not suitable for use on extended trips or for camping purposes or the like.

SUMMARY OF THE INVENTION

The present invention is broadly directed toward a sublimation type refrigeration system which may be used with an insulated cooler to maintain controlled refrigeration temperatures for extended periods of time. The refrigeration system may be formed integrally with a cooler or may take the form of an add-on unit that may be inserted into conventional coolers and removed to allow the coolers to be used in their more conventional form.

The system of the present invention broadly employs a relatively small insulated container for dry ice, a cooling coil structure that receives cooled gases from the dry ice chamber, and an adjustable valve structure connected to the opposite end of the coil and operative to control the escape of gases from the coil to the atmosphere.

The cooling coils are preferably formed as part of a rectangular frame having dimensions complementary to the inner dimensions of the insulated cooler, so that the frame may be inserted within the cooler with the coils disposed in proximity to the interior walls of the cooler. The frame thus supports the coil so as to allow use of substantially all of the cooler area. The only connection required through the wall of the cooler is for the end of the cooling coil that connects to the end of the manually adjustable valve, which is disposed on the exterior of the cooler. This connection may be through the drain hole of the cooler or through a special hole drilled through the side of the cooler.

Adjustment of the valve aperture, and the rate of release of gas in the system to the atmosphere, thus adjusts not only the pressure on the dry ice chamber, and thus the rate of sublimation of the dry ice, but the pressure within the cooling coils as well. This results in a more uniform cooling effect over the entire area of the cooling coil.

The manually adjustable valve of the present invention, which regulates the escape of the gaseous carbon dioxide to the atmosphere, incorporates a novel design including a threaded stem having an adjustment handle at one end and a central aperture normally closed off with a press-fitted blow-out plug. The blow-out plug acts as a safety valve to open the system to atmosphere as excessive pressures are built up by a malfunction of the valve. The blow-out plug may be reinserted into the valve by simply tapping it from the handle side.

To simplify the manual adjustment of the valve the system of the present invention provides a visual indicator of the rate of flow of gas from the coil to the atmosphere. The indicator takes the form of a fluid container having a transparent window. An atmosphere vent is provided at the top of the chamber and the escaping gas is introduced at the lower side. The gas bubbles upwardly through the liquid and the rate of bubble flow may be visually observed to aid in manual adjustment of the valve. The indicator can be connected at any point in the coil system but is preferably provided between the valve and the atmosphere.

The system of the present invention thus provides a simple, low-cost and highly efficient refrigerating system for portable coolers and the like. Other objects, advantages and applications of the present invention will be made apparent by the following detailed description of a preferred embodiment of the invention. The description makes reference to the accompanying drawings in which:

FIG. 5 is a sectional view through the dry ice container taken along line 5—5 of FIG. 2;

FIG. 6 is a diagrammatic perspective view of the cooling system of the cooler;

FIG. 7 is an enlarged view of the control system of the cooler; and

FIG. 8 is a sectional view taken along line 8—8 of FIG. 7.

Figures 1, 2:
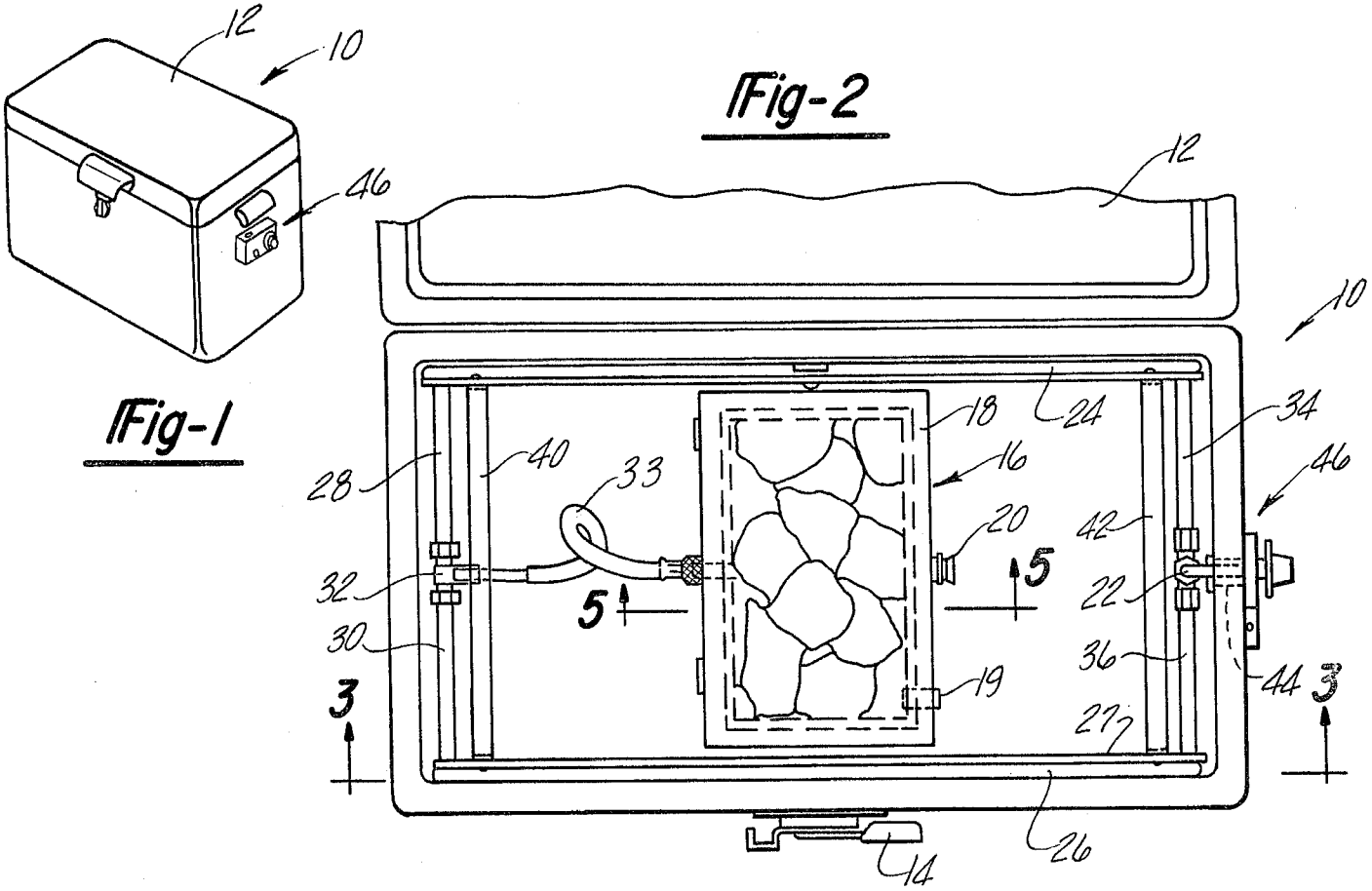
FIG. 1 is an isometric view of a cooler incorporating the invention.
FIG. 2 is a plan view of the cooler with the lid opened to reveal the internal mechanism.
Figure 3:
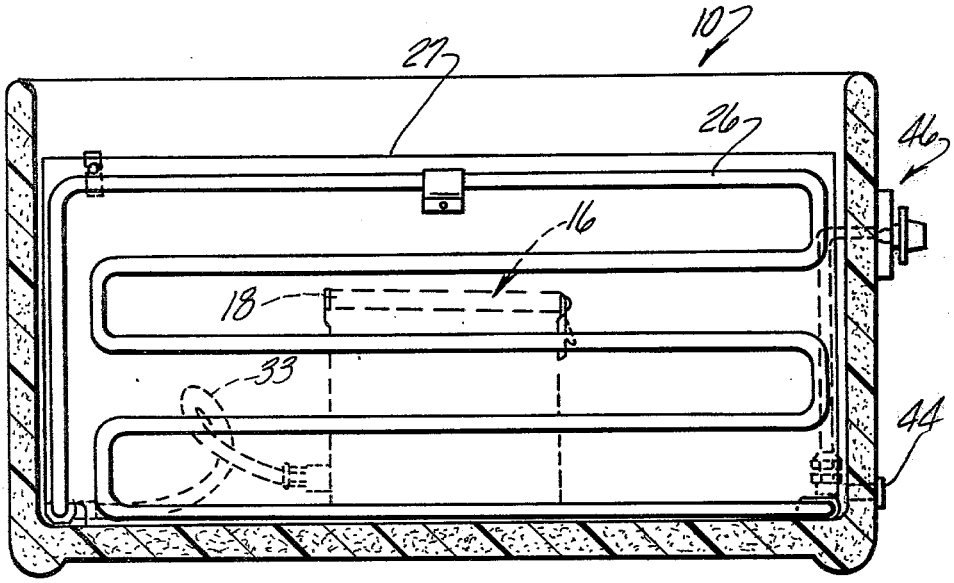
FIG. 3 is a sectional view taken along line 3—3 of FIG. 1.
Figure 4:
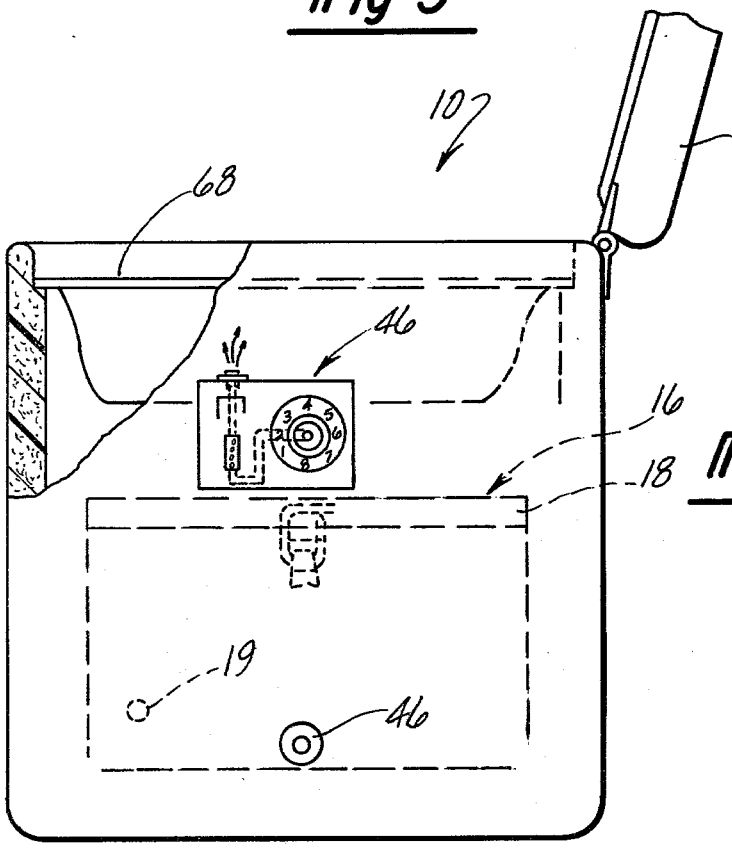
FIG. 4 is an end view of the cooler partially in section.

The invention employs a conventional insulated cooler 10 of the type sold for picnic coolers and the like. These coolers are generally rectangular with a hinged top 12. A latch 14 allows the top to be closed so as to seal the contents of the cooler from the atmosphere.

The preferred embodiment of the cooler is rectangular and the refrigeration apparatus, subsequently described, is adapted for insertion in such a rectangular container, but alternative embodiments of the invention could employ other shapes, such as cylindrical coolers, and other components of the invention could be formed for use with these units.

The cooler 10 may be of the present commercially available variety or may be specially formed for use with the refrigeration system of the present invention.

The refrigeration system employs a dry-ice container 16 taking the form of a rectangular box with an open top, the box having walls formed of a material with excellent insulation properties, such as foamed plastic or the like. The dimensions of the container 16 are much smaller than the dimensions of the cooler 10 with the container disposed within the cooler and only occupying a small percentage of its volume. The container 16 preferably has a length complementary to the interior width of the cooler 10 so that it may be supported between the interior post sidewalls of the cooler.

The dry ice container 16 has a hinged lid 18 which may be secured by a latch 20. The lid 18 may be opened to allow insertion of dry ice or some other form of frozen, sublimating material into the interior of the container. The lid 18 is then secured with a latch 20 sealing the container 16 except for a gas outlet 22 formed through the side of the container. The lid 18 may be formed of a thermally conductive material such as a metal or a dense plastic to increase the rate of cooling of the cooler 10 and to provide a surface having a lower temperature than the cooler 10. Ice cream and like foods which must be retained at low temperatures may be supported against the surface.

A resilient blow-out plug 19 is inserted into a complementary aperture in the wall of the container 16 to prevent the build-up of dangerous gas pressures in the container in the event of blockage of the cooling coils.

The refrigeration assembly includes a pair of serpentine cooling coils 24 and 26 formed on aluminum plates 25 and 27, respectively. The plates 25 and 27 have dimensions slightly smaller than the interior dimensions of the sidewalls of the cooler 10 so that they may be disposed in proximity to these walls. Coils 24 may be soldered or otherwise secured to their respective plates.

The input end 28 of coil 24 and input end 30 of coil 26 extend from opposed bottom corners of the plate, normally to the plate, toward one another and are joined to an input key connector 32. A flexible conduit 33 joins the input key to the gas outlet 22 of the dry ice container so that gas formed by sublimation of dry ice disposed within the container 16 may pass outwardly through conduit 33 into both of the cooling coils 24 and 26.

The output ends 34 and 36 of the cooling coils 24 and 26 extend normally to the plates 25 and 27 from the lower corners of the plates opposite to the input ends 28 and 30. The output ends 34 and 36 of the two coils are both joined to a central output connection 38. By means of the key connections 32 and 38, the two coils 24 and 26 are essentially connected in pairs. In alternative embodiments of the invention, only a single continuous coil might be employed or other coil sections might be connected in parallel. The coil sections might close the bottom end sidewalls of the container as well as, or instead of, the two sidewalls served by the cooling coils 24 and 26. In alternative embodiments, the cooling coils could be built into the walls of the insulated cooler rather than being inserted into the interior bottom of the cooler.

The pair of metal cross braces 40 and 42 extend between the two upper corners of the aluminum plates 25 and 27 to join the two plates and support cooling coils into a unitary frame. The input ends 28 and 30 and output ends 34 and 36 of the cooling coils act as the bottom brace. The resulting unitary structure has dimensions complementary to the interior walls of the cooler so that the plates 25 and 27 are in immediate contact with the opposed interior sidewalls and the entire volume within the frame, other than that occupied by the container 16, is usable for the storage of food.

The output key valve 38 has connections through the cooler drain hole 44, or another special hole suitably formed through the cooler, to manually adjustable output 46 supported on the exterior sidewall of the cooler. Gas from the cooling coils may be passed through the valve 46, through an associated visual indicator 48, and vented to the atmosphere from the indicator.

As will be subsequently described in detail, the visual indicator 48 allows the valve 46 to be adjusted to control the rate of flow of gas from the coils 24 and 26 to the atmosphere. This in turn controls the gas pressure within the coils and the pressure within the dry ice container. Since the rate of sublimation of the dry ice disposed within the container is a function of its external pressure, the setting of the valve 46 effectively controls the rate of sublimation of the dry ice and the temperature within the cooler 10. By closing off the valve 46 completely, the pressure within the container 16 in the cooling coils 24 and 26 is increased, so that the rate of sublimation of the dry ice is very slow and almost no loss of dry ice occurs.

The valve 46 includes a hollow rectangular body 50 connected to the output key 38 through a central passage 51. The flanged coupling 52 with an internal thread extends partially across the width of the body 50 and a threaded valve stem 54 is screwed within the threaded section 52. A handle 56 is affixed to the outer end of the stem 54 allowing adjustment of the stem within the valve body and control of the aperture through which the gas flows from the input end 51. Suitable indicia 57 formed about the exterior of the valve body 50 allow repeatable adjustment of the handle.

A central aperture 58 is formed through the valve stem 54 and is closed off by a rubber blow-out plug 60. The plug 60 is press-fitted within the central aperture 58 and allows for the safe excape of excessive pressures built up within the coils 24 and 26 in the dry ice container 16. After blow-out, the plug may be reinserted within the aperture by simply tapping with a mallet. Rotation of the handle 56 adjusts the position of the end of the stem 54 relative to the input 51 and thus controls the aperture through which gases pass from the passage 51 into the valve body 50.

The valve body 50 has an exhaust passage 61 that connects through a U-shaped tubular trap 62 to the visual indicator 48. The indicator 48 contains a volume of liquid 64 visible through a window 66 and an atmospheric exhause 67 at its upper end. Gas passing through the valve body 50 and the trap 62 bubbles up through the liquid 64 contained within the indicator and these bubbles may be observed through window 66. This provides a visual indication of the rate of flow of gas from the coils and allows the valve 46 to be adjusted by the handle 56 to control the rate of gas outflow.

The cooler may be equipped with a tray 66 which extends across the width of the cooler and supported at the top of the aluminum plates 25 and 27 wherein suitable apertures are formed in the interior walls of the cooler 10. These trays may be used to support various foods within the cooler.

The embodiments of the invention in which an exclusive property or privilege is claimed are defined as follows:

1. A sublimation refrigerator, comprising: an insulated outer container including a cover movable between an open position in which the container is sealed; an inner container for a sublimated solid adapted to be disposed within the outer container, the inner container having a removable cover; a frame having dimensions complementary to the inner dimensions of a wall of the outer container; an elongated cooling coil disposed in a convoluted configuration fixed to the frame, one end of the cooling coil being connected to the interior of the container for the sublimated solid; and manually adjustable valve means connecting the other end of the coil to the exterior of the outer container, whereby the frame may be disposed within the outer container in abutment to said wall and a sublimation solid may be disposed within the inner container and the valve adjusted so as to produce a gaseous pressure within the inner container and the coil allowing sublimation of the solid and control of the temperature within the outer container, or, alternatively, the frame may be removed from the outer container allowing use of the outer container as an unrefrigerated cooler.

2. The refrigerator of claim 1 wherein the coil is formed of two sections forming opposed walls of the rectangular frame, the opposed walls being adapted to be supported on adjacent opposed side walls of the outer container.

3. The refrigerator of claim 1 wherein said adjustable valve includes blow-out means adapted to create relatively unrestricted communication between the coil end to which the valve is connected and the atmosphere upon the occurrence of a pressure in the coil which exceeds a predetermined pressure.

4. The refrigerator of claim 3 wherein said manually adjustable valve includes an externally threaded valve stem movable within the valve body and said blow-out means comprises a central aperture formed through the stem and a blow-out plug adapted to be press fitted into said aperture.

5. The refrigerator of claim 4 including a handle affixed to the valve stem at one end thereof, having the central aperture formed centrally within the handle, whereby said blow-out plug may be press-fitted into the central aperture, and adjacent the handle.

6. The refrigerator of claim 5 including indicator means connected between the valve and the aperture, said indicator means including a body of fluid and a transparent window at least partially enclosing the fluid body, the indicator being adapted to be connected to the valve so that gas passing through the valve from the coil passes through the body of liquid.

7. In a sublimation refrigerator including a container adapted to support a sublimation solid and an elongated cooling coil having one end connected to the container so that gas produced upon the sublimation of the solid through the cooling coil, produces a cooling effect, the improvement comprising: manually adjustable valve means connected to the coil; an indicator connected to the valve means, said indicator including a body of fluid and a transparent window partially enclosing said body of fluid so that the condition of the body of fluid is visible from its exterior, and connections between said valve and said indicator so that gas passing through the coil passes through the valve and the indicator and into the atmosphere, whereby a visual indication of the volume of the gas passing through the indicator is produced, to aid in manual adjustment of the valve.

8. The refrigerator of claim 7 wherein said valve encludes an elongated, externally threaded stem, a handle formed in one end of the stem, a central aperture formed through the stem; a blow-out plug adapted to be press-fitted into the aperture from the handle end; a pressure section adapted to be connected to the coil and operative to cooperate with the end of the stem opposite to the handle end so as to control the area of the aperture through which gas may flow outwardly from the coil.

9. A sublimation refrigeration assembly adapted to be employed in connection with an insulated container, comprising: a container for a sublimation solid having dimensions allowing it to be disposed within the insulation container, having a removable cover; a frame having dimensions complementary to the interior dimensions of the insulated container, whereby said frame may be inserted within the sealed container in proximity to at least certain of the exterior walls thereof, said frame including an elongated convoluted cooling coil having one end connected to the interior of said container for a sublimation solid and means for connecting the opposite end of the coil to the exterior of the insulated container.

10. A sublimation refrigeration assembly of claim 9 wherein said means for connecting the opposite end of the coil to the exterior of the insulated container includes manually adjustable valve means operative to control the flow of gas from the coil to the atmosphere.

11. The refrigerator of claim 10 wherein said adjustable valve includes blow-out means adapted to create relatively unrestricted communication between the coil end to which the valve is connected and the atmosphere upon the occurrence of a pressure in the coil which exceeds a predetermined pressure.

12. The refrigerator of claim 11 wherein said manually adjustable valve includes an externally threaded valve stem movable within the valve body and said blow-out means comprises a central aperture formed through the stem and a blow-out plug adapted to be press fitted into said aperture.

13. The refrigerator of claim 12 including a handle affixed to the valve stem at one end thereof, having the central aperture formed centrally within the handle, whereby said blow-out plug may be press fitted into the central aperture, and adjacent the handle.

14. The refrigerator of claim 13 including indicator means connected between the valve and the aperture, said indicator means including a body of fluid and a transparent window at least partially enclosing the fluid body, the indicator being adapted to be connected to the valve so that gas passing through the valve from the coil passes through the body of liquid.

* * * * *